US006206597B1

(12) United States Patent
Griebel et al.

(10) Patent No.: US 6,206,597 B1
(45) Date of Patent: Mar. 27, 2001

(54) PROCESS FOR PRODUCING A STICK-LIKE IMPLEMENT

(75) Inventors: Ulrich Griebel, Altdorf; Georg Roeder, Schwabach; Wolfgang Winkler, Lauf, all of (DE)

(73) Assignee: Schwan Stabilo Cosmetics GmbH & Co., Heroldsberg (DE)

( * ) Notice: Subject to any disclaimer, the term of this patent is extended or adjusted under 35 U.S.C. 154(b) by 0 days.

(21) Appl. No.: 09/426,040

(22) Filed: Oct. 25, 1999

(30) Foreign Application Priority Data

Nov. 30, 1998 (DE) ..... 198 55 210

(51) Int. Cl.[7] ..... A45D 40/04; A45D 40/06

(52) U.S. Cl. ..... 401/68; 29/413; 29/434; 29/469; 29/527.3

(58) Field of Search ..... 29/418, 434, 469, 29/527.3, 413; 401/68; 264/242, 318

(56) References Cited

U.S. PATENT DOCUMENTS

| | | | | |
|---|---|---|---|---|
| 3,623,822 | * | 11/1971 | Davidson | 401/78 |
| 4,180,163 | * | 12/1979 | Grioni | 206/385 |
| 4,280,976 | * | 7/1981 | Von Holdt | 264/152 |
| 4,479,548 | * | 10/1984 | Gilbert | 166/387 |
| 4,741,088 | * | 5/1988 | Ramella | 29/450 |
| 4,770,556 | * | 9/1988 | Ackermann et al. | 401/69 |
| 4,820,070 | * | 4/1989 | Spatz | 401/87 |
| 4,863,300 | * | 9/1989 | Arona-Delonghi | 401/68 |
| 5,000,600 | * | 3/1991 | Cardia et al. | 401/75 |
| 5,018,892 | * | 5/1991 | Krueckel et al. | 401/68 |
| 5,085,352 | * | 2/1992 | Sasaki et al. | 222/327 |
| 5,145,078 | * | 9/1992 | Hannon et al. | 215/252 |
| 5,172,993 | * | 12/1992 | Ackermann et al. | 401/69 |
| 5,174,673 | * | 12/1992 | Gruner | 401/78 |
| 5,240,337 | * | 8/1993 | Gruner | 401/78 |
| 5,281,385 | * | 1/1994 | Julian | 264/318 |
| 5,379,922 | * | 1/1995 | Paradoski | 222/153 |
| 5,597,252 | * | 1/1997 | Ito et al. | 401/78 |
| 5,609,263 | * | 3/1997 | Perchepied | 215/252 |
| 5,749,664 | * | 5/1998 | Inoue et al. | 401/78 |
| 5,765,955 | * | 6/1998 | Tani | 401/68 |
| 5,873,667 | * | 2/1999 | Inoue et al. | 401/78 |
| 5,875,908 | * | 3/1999 | Witt et al. | 215/256 |
| 5,913,436 | * | 6/1999 | Breuer | 215/252 |
| 5,975,781 | * | 11/1999 | Ackermann et al. | 401/69 |
| 5,997,350 | * | 12/1999 | Burris et al. | 439/585 |

FOREIGN PATENT DOCUMENTS

| | | | | |
|---|---|---|---|---|
| 3316573 | * | 11/1984 | (DE) | A45D/40/06 |
| 2197295 | * | 5/1988 | (GB) | A45D/40/06 |

* cited by examiner

*Primary Examiner*—S. Thomas Hughes
*Assistant Examiner*—Essama Omgba
(74) *Attorney, Agent, or Firm*—Bachman & LaPointe, P.C.

(57) ABSTRACT

A process for producing a stick-like implement, having a first sleeve, having a second sleeve with an insertion section for insertion into the first sleeve, it being possible for the two sleeves to be rotated with respect to one another in the inserted state, having an externally threaded element which is coupled to the second sleeve in a rotationally fixed but axially displaceable manner and is designed to mesh with an internally threaded element which is coupled to the first sleeve in a rotationally fixed manner, with the result that rotation of the two sleeves with respect to one another results in axial displacement of the externally threaded element in relation to the sleeves, and having a filler element which, in the case of corresponding axial displacement of the externally threaded element on account of rotation of the two sleeves with respect to one another, is pushed out of a sleeve opening. The second sleeve and the internally threaded element are inserted into the first sleeve as parts which are connected to one another, the connection of the second sleeve to the internally threaded element being such that it is released when the sleeves are rotated with respect to one another.

9 Claims, 2 Drawing Sheets

PROCESS FOR PRODUCING A STICK-LIKE IMPLEMENT

BACKGROUND OF THE INVENTION

The invention relates to a process for producing a stick-like implement, having a first sleeve, a second sleeve with an insertion section for insertion into the first sleeve, it being possible for the two sleeves to be rotated with respect to one another in the inserted state, having an externally threaded element which is coupled to the second sleeve in a rotationally fixed but axially displaceable manner and is designed to mesh with an internally threaded element which is coupled to the first sleeve in a rotationally fixed manner, with the result that rotation of the two sleeves with respect to one another results in an axial displacement of the externally threaded element in relation to the sleeves, and having a filler element which, in the case of corresponding axial displacement of the externally threaded element on account of rotation of the two sleeves with respect to one another, is pushed out of a sleeve opening.

Processes of the type mentioned in the introduction are known See U.S. Pat. No. 5,018,892. The known processes provide for the internally threaded element to be formed integrally with the first sleeve. This usually takes place in that the first sleeve is produced by injection molding using a mold with an external thread which corresponds to the internally threaded element. The production is thus comparatively complicated.

If the internally threaded element is not formed integrally with the first sleeve, but rather as a separate part, then it has to be introduced into the first sleeve, during assembly of the stick-like implement, in a process step provided specifically for this purpose. This solution also involves comparatively high outlay.

The object of the invention is to specify a process of the type mentioned in the introduction by means of which it is possible, in a straightforward manner, for the interior of the first sleeve to be provided with an internally threaded element.

SUMMARY OF THE INVENTION

The foregoing object is achieved according to the invention in that the second sleeve and the internally threaded element are inserted into the first sleeve as parts which are connected to one another, the connection of the second sleeve to the internally threaded element being such that it is released when the sleeves are rotated with respect to one another.

The invention is based on the finding that it is possible to eliminate a process step if the internally threaded element is introduced into the first sleeve during the step, which is necessary anyway, in which the second sleeve is inserted into the first sleeve. Since, according to the invention, the connection between the second sleeve and the internally threaded element is weak enough to be released when the two sleeves are rotated with respect to one another, those parts which are still connected to one another for the purpose of introduction into the first sleeve, namely the second sleeve and the internally threaded element, can be separated from one another following the insertion into the first sleeve, which is imperative for the functioning of the rotary mechanism provided in the stick-like implement.

It is thus not necessary according to the invention either for the internally threaded element to be introduced separately into the first sleeve or for an internally threaded element to be provided on the first sleeve itself.

The overall result is thus a considerable simplification of known processes for producing a stick-like implement.

The insertion into the first sleeve preferably takes place at least until the internally threaded element comes up against a stop within the first sleeve. It is then possible for the internally threaded element to be supported axially on said stop during the actual actuation of the rotary mechanism, this forming an abutment in order to push the filler element out through the sleeve opening.

The second sleeve and the internally threaded element are preferably produced as parts which are connected integrally to one another and have a predetermined breaking point as a connection between them. In the case of the second sleeve being produced by injection molding, the internally threaded element thus constitutes a part which is integrally formed on the second sleeve by injection molding.

The externally threaded element is preferably introduced into the second sleeve with the internally threaded element still connected thereto, it being the case that the internally threaded element can be changed in terms of its effective diameter and, upon introduction of the externally threaded element, is in an operating state in which it does not mesh with the externally threaded element. This configuration makes it possible for the externally threaded element to be introduced into the internally threaded element (which is still integral with the second sleeve) by straightforward axial displacement, without a screwing movement being required on account of the meshing of the two threaded elements with one another. This means that the insertion of the external element into the second sleeve with the internal element located thereon can be automated particularly easily.

It is preferably provided for the filler element to be fastened on the externally threaded element. This makes it possible, by virtue of the two sleeves being rotated with respect to one another, for the filler element not just to be pushed out of the sleeve opening but—by virtue of the rotation in the opposite direction—also to be drawn in again through the sleeve opening.

The fastening of the filler element on the externally threaded element preferably takes place by the molding-on operation. The molding-on operation makes it possible, on the one hand, to achieve a particularly intimate connection between the externally threaded element and the filler element. On the other hand, a process step is once again eliminated. This is because, if the filler element were not molded on, it would have to be produced in a first step and fastened on the externally threaded element in a second step.

According to the invention, the filler element is preferably molded onto the externally threaded element in that the externally threaded element is fitted on a mold and the filler-element material is introduced into the mold by means of a cannula which is introduced into a corresponding through-passage opening in the externally threaded element. This means that the working surface of the filler element is free of spurs.

The externally threaded element, with the filler element fastened thereon, is preferably located within the second sleeve when the second sleeve is inserted into the first sleeve. This achieves the situation where the filler element can be fastened on the externally threaded element without the first sleeve being in the way. The result of this is a further simplification of the production process.

BRIEF DESCRIPTION OF THE DRAWINGS

The invention is explained in more detail hereinbelow by way of a preferred exemplary embodiment and with reference to the attached drawing, with further details, in which.

DETAILED DESCRIPTION

Figure 1:
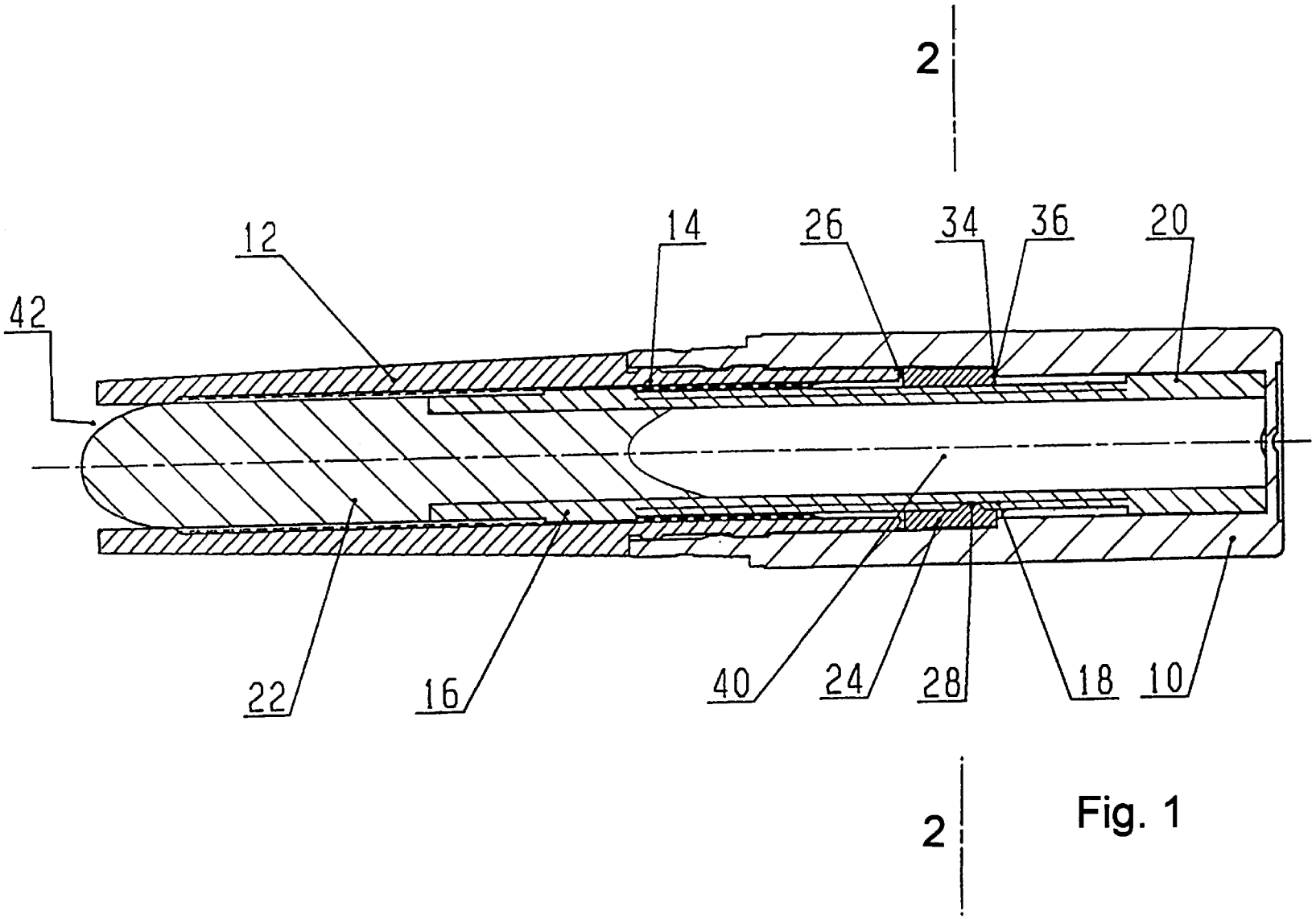
FIG. 1 shows an axial-section view of a stick-like implement which is produced according to a preferred exemplary embodiment of the process according to the invention.

The attached figures show a stick-like implement with a shank or first sleeve 10 which has been assembled with a holding part or second sleeve 12, an insertion section 14 of the holding part 12 extending into the shank 10. The holding part 12 can be rotated with respect to the shank 10. The drawing does not illustrate devices, such as snap-action noses or the like, which retain the insertion section 14 in the shank 10. A filler-element mount 16 is arranged within the holding part 12 and the shank 10. It bears an external thread 18. Furthermore, it is provided with a guide part 20, the function of which will be explained in more detail below.

Molded onto the filler-element mount 16, at the end which is located opposite the guide part 20, is a filler element 22 which extends some way into the filler element mount 16.

Figure 2:
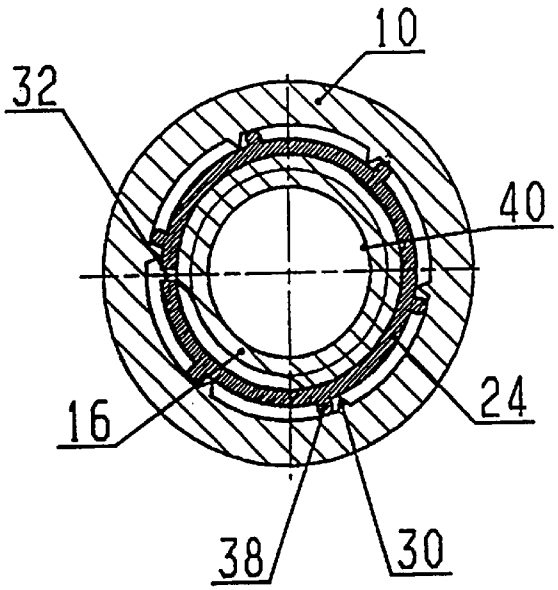
FIG. 2 shows a cross-sectional view along line 2—2 in FIG. 1.

In the state which is illustrated in FIG. 1, the end section or attachment 24 of the holding part 12, said end section being directed away from the filler element 22, is connected to the rest of the holding part 12 via a predetermined breaking point 26. It bears an internal thread 28 which is designed for meshing with the external thread 18 of the filler-element mount 16. As can be gathered from FIG. 2, the attachment 24 has provided in it a slit 32 which extends in the axial direction. In this case, the holding part 12, with the attachment 24 originally located thereon, is configured such that those regions of the attachment 24 which are separated from one another by the slit 32 are prestressed in the opening direction. The function of this prestressing in the opening direction will be explained in more detail below.

The attachment 24 and the shank 10 have shoulders 34, 36 which correspond to one another and limit the amount by which the attachment 24 is pushed into the shank 10. Furthermore, the attachment 24 and the shank 10 have ribs, of which two, by way of example, have the designations 38 and 30, respectively, in FIG. 2. The ribs 38, 30 serve for preventing the attachment 24 and the shank 10 from rotating with respect to one another.

The filler-element mount 16 is provided with a longitudinal channel 40.

At its filler-element end, the holding part 12 has an opening 42. The opening 42 can be closed off by means of a protective cap (not illustrated in the drawing).

Figure 3:
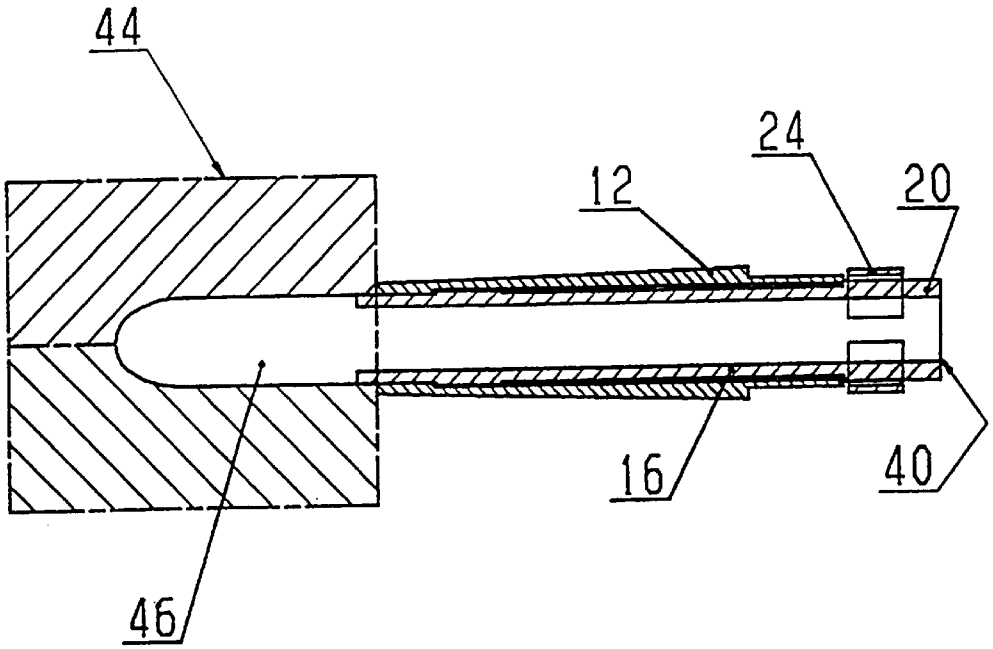
FIG. 3 shows a schematic sectional view of a molding-on operation.

The stick-like implement illustrated in the drawing is preferably produced according to the invention as follows:

In a first step, the filler-element mount 16 is pushed into the holding part 12, from the side which is located opposite the opening 42, until the filler-element mount 16 projects out of the opening 42 by way of its end which is located opposite the guide part 20. In this state, it is fitted on a mold 44, which has a cavity 46 corresponding to the filler element which is to be molded. This process step is illustrated in FIG. 3, the elements 10, 16 and 20 only being represented schematically.

A cannula (not illustrated in the drawing) is then introduced into the cavity 46 through the longitudinal opening 40 and the filler-element material is introduced into the cavity 46 through the cannula. Once the filler-element material has solidified to a sufficient extent, the filler-element mount 16, with the filler element 22 molded onto it, is drawn back within the holding part 12.

Both with this drawing-back operation and with the previous operation of pushing the filler-element mount 16 into the retaining part 12, those regions of the attachment 24 which are separated from one another by the slit 32 are spread apart to such an extent that the internal diameter of the internal thread 28 on the attachment 24 is greater than the external diameter of the thread 18 on the filler-element mount 16, with the result that pushing in and drawing back are possible without the filler-element mount 16 having to be rotated in relation to the holding part 12 on account of meshing threads. This means that the pushing-in operation and drawing-back operation are particularly straightforward.

In the next step, the holding part 12, with the filler-element mount 16 inserted therein, is inserted into the shank 10 until the entire arrangement is in the state shown in FIG. 1.

In this state, the stop 34 of the attachment 24 strikes against the stop 36 of the shank 10.

In the spread-apart state, i.e. when the slit 32 is open, the external diameter of the attachment 24 is somewhat greater than the internal diameter of the shank 10. This means that the attachment 24 is compressed when it is introduced into the shank 10, as a result of which the slit 32 closes. In this compressed state, the internal diameter of the attachment 24 is such that it meshes with the thread 18 on the filler-element mount 16.

The filler-element mount 16 and the holding part 12 are coupled to one another in terms of rotation. The rotary coupling between the holding part 12 and the filler-element mount 16 is realized in the same way as the rotary coupling of the shank 10 and the attachment 24, that is to say by means of ribs which correspond to the ribs 38, 30.

Instead of the ribs, it is also possible to use non-rotationally-symmetrical contours, for example to use a polygon, as a rotation-prevention means.

If then, in the operating state shown in FIG. 1, the holding part 12 is rotated with respect to the shank 10, then the attachment 24 rotates with the shank 10 on account of the ribs 38, 30. This results in the predetermined breaking point 26 breaking. Once the predetermined breaking point 26 has broken, the attachment 24 constitutes an internally threaded element which, together with the shank 10, rotates with respect to the holding part 12, as a result of which the filler-element mount 16, with the filler element 22 located thereon, is pushed out of the opening 42 to the left in the axial direction in FIG. 1. Along with the filler element 22, the guide part 20 also moves to the left in the axial direction in FIG. 1, said guide part serving, during this axial movement, for preventing radial tilting of the filler-element mount 16 and of the filler element 22.

The features of the invention which are disclosed in the above description, claims and the drawing may be essential both individually and in any desired combinations for the purpose of realizing the various embodiments of the invention.

What is claimed is:

1. A process for producing a stick-like implement, comprising:

providing a first sleeve (10);

providing a second sleeve (12) having an insertion section (14);

inserting the insertion section into the first sleeve (10) such that the two sleeves (10, 12) rotate with respect to one another;

providing an externally threaded element (16, 18);

coupling the externally threaded element to the second sleeve (12) in a rotationally fixed but axially displaceable manner wherein the externally threaded element meshes with an internally threaded element (24, 28) which is unitary with the second sleeve (12) in a rotationally fixed manner, such that subsequent rotation of the two sleeves (10, 12) with respect to one another results in axial displacement of the externally threaded element (16, 18) in relation to the sleeves (10, 12);

providing a filler element (22) which, upon axial displacement of the externally threaded element (16, 18) resulting from rotation of the two sleeves (10, 12) with respect to one another, is pushed out of an opening (42) in the second sleeve (12), wherein the second sleeve (12) and the internally threaded element (24, 28) are inserted into the first sleeve (10) as parts which are connected to one another, the connection of the second sleeve (12) to the internally threaded element (24, 28) being such that it is released when the sleeves (10, 12) are rotated with respect to one another; and rotating the second sleeve relative to the externally threaded member whereby the internally threaded member is separated from the second sleeve for pushing the filler element out of the opening.

2. The process as claimed in claim 1, wherein the externally threaded element (16, 18) is introduced into the second sleeve (12) with the internally threaded element (24, 28) still connected thereto, it being the case that the internally threaded element (24, 28) can be changed in terms of its effective diameter and, upon introduction of the externally threaded element (16, 18), is in an operating state in which it does not mesh with the externally threaded element (16, 18).

3. The process as claimed in claim 2, wherein the externally threaded element (16, 18), with the filler element (22) fastened thereon, is located within the second sleeve (12) when the second sleeve (12) is inserted into the first sleeve (10).

4. The process as claimed in claim 1, which comprises the step of fastening the filler element (22) on the externally threaded element (16, 18).

5. The process as claimed in claim 4, wherein the fastening takes place by the filler element (22) being molded onto the externally threaded element (16, 18).

6. The process as claimed in claim 5, wherein the externally threaded element (16, 18) is fitted on a mold (44) and the filler-element material is introduced into the mold (44) by means of a cannula which is introduced into a corresponding through-passage opening (40) in the externally threaded element (16, 18).

7. The process as claimed in claim 1, wherein the insertion into the first sleeve (10) takes place at least until the internally threaded element (24, 28) comes up against a stop (36) within the first sleeve (10).

8. The process as claimed in claim 1, wherein the second sleeve (12) and the internally threaded element (24, 28) are produced as parts which are connected integrally to one another and have a predetermined breaking point (26) as a connection between them.

9. A stick-like implement consisting essentially of:

a first sleeve;

a second sleeve having on one end an opening and on another end an insertion means for insertion into the first sleeve wherein the two sleeves rotate with respect to one another such that relative rotation of the sleeves results in axial displacement of an externally threaded element;

the externally threaded element coupled to the second sleeve in a rotationally fixed but axially displaceable manner;

an internally threaded element unitary with the second sleeve in a rotationally fixed manner wherein the externally threaded element meshes with the internally threaded element; and a filler element positioned within said second sleeve in such a manner that upon axial displacement of the externally threaded element, the filler element is pushed out of said opening wherein the connection of the second sleeve with the internally threaded element is released upon relative rotation of the sleeves.

* * * * *